United States Patent [19]

Rooklyn

[11] Patent Number: 4,525,398

[45] Date of Patent: Jun. 25, 1985

[54] CONDUCTIVE LAMINATE PRODUCT FOR APPLICATION TO VERTICAL AND HORIZONTAL SURFACES

[75] Inventor: Jack Rooklyn, Northridge, Calif.

[73] Assignee: Industrial Management Co., Chatsworth, Calif.

[21] Appl. No.: 640,137

[22] Filed: Aug. 13, 1984

Related U.S. Application Data

[63] Continuation-in-part of Ser. No. 613,088, May 22, 1984, , which is a continuation-in-part of Ser. No. 286,611, Jul. 24, 1981, Pat. No. 4,456,944, which is a continuation-in-part of Ser. No. 180,962, Aug. 25, 1980, abandoned.

[51] Int. Cl.[3] ..... B32B 5/16; B32B 15/04

[52] U.S. Cl. ..... 428/40; 428/332; 428/339; 428/457; 428/458; 428/479.6; 428/530

[58] Field of Search ..... 428/457, 458, 479.3, 428/479.6, 474.4, 332, 323, 339, 221, 409, 502, 503, 507, 511, 530, 40, 334, 335; 252/511; 162/138

[56] References Cited

U.S. PATENT DOCUMENTS

| | | | |
|---|---|---|---|
| 1,609,222 | 11/1926 | Taylor | 428/139 |
| 2,241,312 | 5/1941 | Loty | 428/138 |
| 4,301,040 | 11/1981 | Berbeco | 428/317.9 |
| 4,320,169 | 3/1982 | Yatabe et al. | 428/458 X |
| 4,345,000 | 8/1982 | Kawazoe | 428/458 X |
| 4,370,191 | 1/1983 | Uekita et al. | 428/458 X |
| 4,455,350 | 6/1984 | Berbeco | 162/138 X |
| 4,463,054 | 7/1984 | Nelson | 428/458 |

*Primary Examiner*—Lorraine T. Kendell
*Attorney, Agent, or Firm*—Evanns & Walsh

[57] ABSTRACT

A conductive laminate product capable of dissipating static charges and adapted for use on vertical and horizontal surfaces. The laminate product is formed of a thin, hard layer of plastic material, a thin layer of metallic foil which is electrically conducted, bonded to the top layer by way of an electrically conducted adhesive material and a layer of backing material secured to the metallic foil.

9 Claims, 8 Drawing Figures

CONDUCTIVE LAMINATE PRODUCT FOR APPLICATION TO VERTICAL AND HORIZONTAL SURFACES

This application is a continuation-in-part of Application Ser. No. 06/613,088 filed May 22, 1984, which in turn is a continuation-in-part of application Ser. No. 286,611, filed July 24, 1981, now U.S. Pat. No. 4,456,944; which in turn is a continuation-in-part of application Ser. No. 180,962, filed Aug. 25, 1980, and now abandoned.

BACKGROUND OF THE INVENTION

1. Field of the Invention

The field of the invention is more particularly that of a laminate product which is conductive and which is manufactured for, and adapted for, application to vertical and horizontal surfaces where a control of static discharge is required and a decorative wear and stain-resistive surface is desirable.

2. Description of the Prior Art

Efforts have been made in the past to realize a product providing a conductive surface which is sufficiently electrically conductive to be able to drain off any accumulated static charge. One type of product has been a structure in which a layer of carbon is painted onto the back of a lamination, that is, for example, a lamination of plastic to attempt to provide an electrically conductive work surface. There are disadvantages in this type of construction which include that the carbon will attack silver; also, the carbon cannot be used in a clean room since it will contaminate the atmosphere; and further, eventually the carbon will dissipate into the atmosphere and lose its conductivity. While this type of product is intended as an electrically conductive work surface, typically it is not physically suitable because of its construction for use, for example, on horizontal floor surfaces or vertical wall surfaces. The product as referred to is typically too thick, heavy and cumbersome for application as stated to flat horizontal or vertical surfaces. A need has arisen for this type of product which has not been satisfied because of the characteristics that the product needs to have. These include, of course, that the product must be thin and light in weight and having the characteristic that it can easily be applied to the surface; also that it can be readily fabricated in suitable sizes and cut into smaller pieces, if desired. The herein invention provides a product which is of a nature to meet the requirements as stated.

SUMMARY OF THE INVENTION

A preferred form of the product of the invention is described in detail hereinafter.

The product in the preferred form is a laminate, including a lamination of commercially available material which preferably may be a plastic sheet of melamine which is a hard, relatively thin layer. A layer of aluminum foil is applied to the back of the aforesaid lamination by pressing at relatively high temperature and pressure. The aluminum foil is a thin layer which may have a thickness from 0.007 to 0.015 inches, depending on the speed of dissipation of accumulated static charge desired.

Electrically conductive adhesive is used to apply the aluminum sheet to the back of the plastic lamination. Then a backing sheet is placed over the conductive aluminum foil sheet, and all of these layers are fabricated by pressing at relatively high temperature and pressure. Preferably, the backing sheet is a layer of Kraft paper, which is standard paper, and goes over the sheet of aluminum.

The product is fabricated in relatively thin sheets and is adaptable to horizontal surfaces, such as floors, and vertical surfaces, such as walls, particularly for example as needed in a clean room or an environment in which it is necessary or desirable to drain off static charges that may accumulate.

In the light of the foregoing, the primary object of the invention is to provide and realize a product which is conductive and from which accumulated static charges can accumulate, and which is suitable for application to vertical and horizontal surfaces.

A further object is to realize a product as in the foregoing which is relatively light in weight and inexpensive and relatively simple to fabricate.

A further object is to realize a product as in the foregoing which is adapted for application to horizontal and vertical surfaces by way of self-adhesive backing.

A further object is to realize a product as in the foregoing which can accommodate a decay rate of 5,000 volts of static charge in substantially 0.003 seconds.

A further object is to realize a product as in the foregoing which is resistant to most organic solvents, that is, they will not harm the surface; also, surfaces that may be cleaned simply with a damp cloth and ordinary soap and liquid detergent.

Further objects and additional advantages of the invention will become apparent from the following detailed description and drawings.

DESCRIPTION OF A PREFERRED EMBODIMENT METHOD AND MODE OF OPERATION

Figure 1:
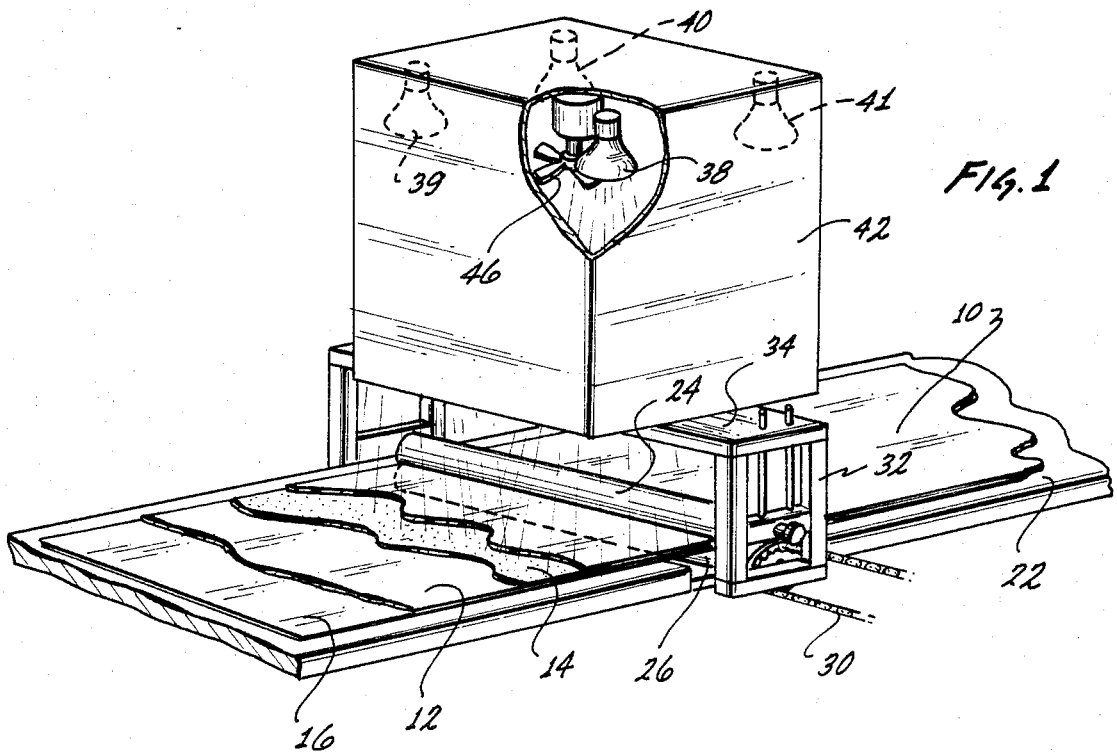
FIG. 1 is a schematic view of equipment utilized in fabricating the material by way of laminating at temperature and pressure.
Figure 2:
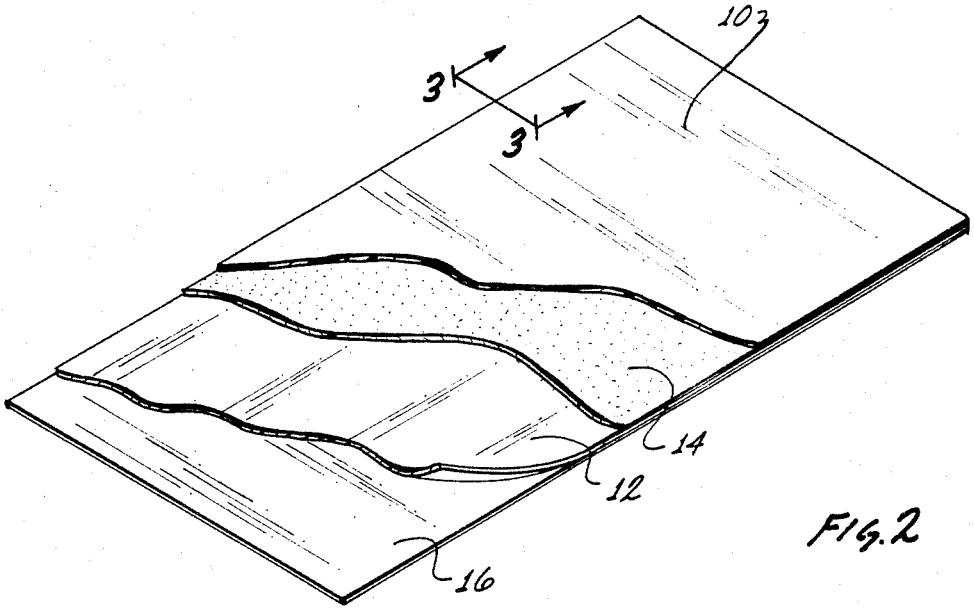
FIG. 2 is an isometric view of a section of the finished product cut into a predetermined size, with laminations broken away.
Figure 3:
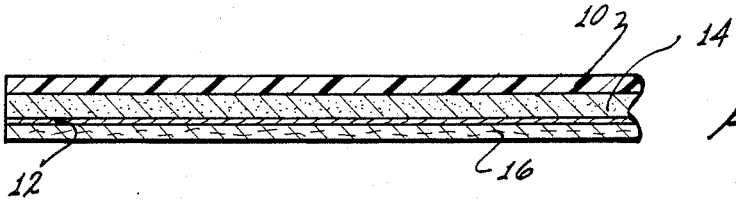
FIG. 3 is an enlarged enlarged partial view illustrating the laminated construction of the product.
Figure 4:
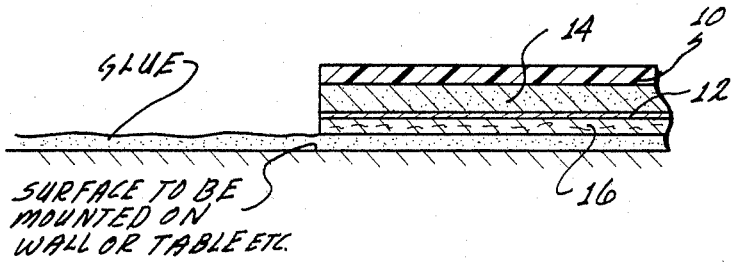
FIG. 4 is a view like that of FIG. 3 showing the product applied to a surface with adhesive.
Figure 5:
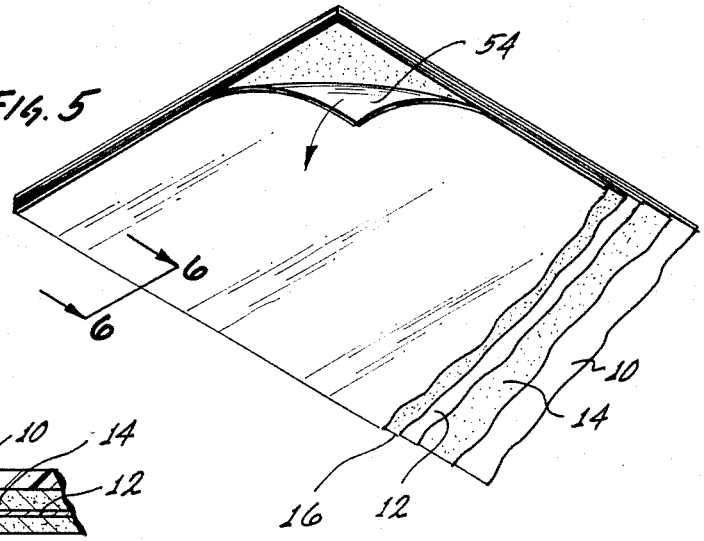
FIGS. 5–8 view and illustrate a modified form of the invention constructed in the form of a pad which can be simply placed or laid upon a work surface after removal of a backing sheet.
Figure 6:
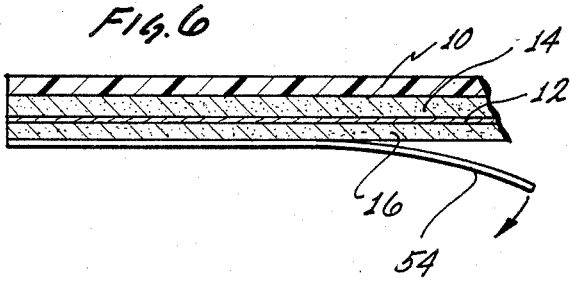
Figure 7:
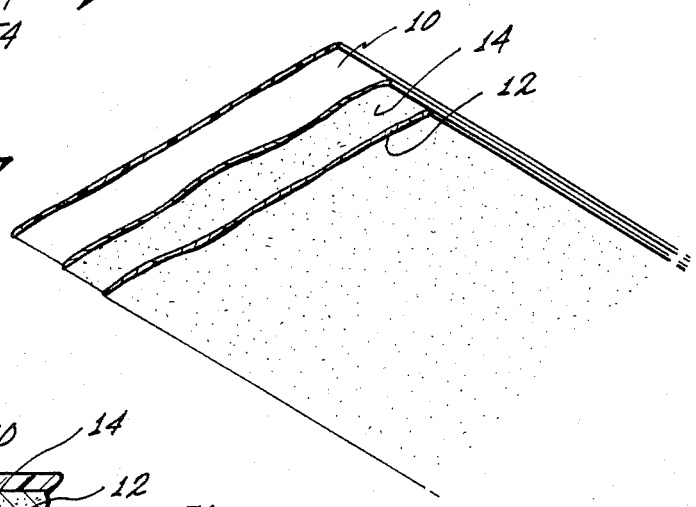

The product of the invention which is referred to as a conductive laminate is manufactured for application to vertical and horizontal surfaces where a control of static charge is required and a decorative wear and stain-resistive surface is desired. A preferred exemplary form of the invention is illustrated in FIGS. 1–4. The product is a laminated product. The top layer or lamination is plastic grade of melamine. This is a standard commercial product consisting of a melamine sheet bonded to one side of a sheet of paper. The product is commercially available. The product may be fabricated with several sheets of impregnated Kraft paper on one side of the melamine sheet as a substrate. These sheets are bonded to the melamine plastic sheet by pressure. This product is available from several commercial sources, including Formica and Wilson-Hart; also, Nevamar. The sheet, identified by numeral 10, may have a thickness of 0.020 inches. It has relatively low dielectric strength. Numeral 12 identifies a layer of aluminum foil which is applied to the back of the plastic laminate by pressing at high temperature and high pressure. Preferably, the aluminum foil may have a thickness of 0.010 inches, the range of thickness preferably being from 0.007 to 0.015, this depending on the speed of dissipation of static charge that may be desired.

A conductive adhesive 14 is used to apply the aluminum sheet to the back of the plastic laminate, and the backing sheet 16 is placed over the conductive aluminum sheet, and all of these layers or laminations are manufactured or fabricated by pressing at high temperature and high pressure. The backing sheet preferably is a layer of standard Kraft paper. For the temperature and pressure for applying the laminations against each other, heat lamps are used and pressure rollers. The temperature may be in a range of 150° F. to 180° F., and the pressure applied is preferably on the order of 500 to 700 pounds per square inch. This temperature and pressure can be varied 15 or 20 percent without greatly affecting the product. Preferably, the top sheet 10 or lamination is one with a relatively harder surface than when this material is used in a static-free work surface product. Commercially available contact adhesive may be used which could be Fast-Bond 30 made by 3M Company. Electrolytic copper, which is 99.7 percent pure copper, 15 to 20 percent by volume, is added, this being a product in the form of a powder. The electrolytic copper is kept suspended by agitation. However, any available contact adhesive could be used. The product identified is used because it is non-inflammable. Solvent-based adhesives are all inflammable. Water-based adhesive is non-inflammable and either could be used.

FIG. 1 is a schematic isometric view of equipment used for bonding the laminations as described above to each other under conditions of temperature and pressure as identified.

Numeral 22 designates a work table over which the laminations may be passed between pressure or pinch rollers. The pinch rollers are identified at 24 and 26, one of them being within an opening in the table 22, and the other one being just above it. The pinch rollers are power driven by way of a chain drive 30, these parts being well-known in the art.

Numeral 32 designates a frame supporting platform 34 over the table 22 and over the pinch rollers. This platform supports the equipment for providing temperature. Heat lamps, as designated at 38, 39, 40 and 41 are provided in the corners of the enclosure 42. Fans are provided as shown to force at 46 the heated air down through holes in the platform 34 and onto the laminations passing between the pinch rollers. Curtains (not shown) may be provided at the ends of the enclosure 42 through which air may be drawn in to be heated and forced down over the laminations passing through the pinch rollers.

As set forth in the foregoing, the product, that is, the conductive laminate, is for use on vertical or horizontal surfaces or other sUrfaces where control of static charge is required and a decorative wear and stain-resistive surface is desired. A mastic adhesive can be applied over the surface of the product, and then the product is stuck to the surface to be covered.

The manufactured product preferably has an average decay rate of 5,000 volts of static charge in 0.003 seconds. The surface resistance to ground is $2.2\times10^9$ ohms.

The product as described is resistant to most organic solvents, such as alcohol, acetone, keytone (MEK), lacquer thinner, paint solvent, etc.

Surfaces of the conductive laminate product may be cleaned with a damp cloth and ordinary soap or household amoniated liquid detergent. Stubborn stains may require the use of organic solvents, such as alcohol, acetone, keytone (MEK), lacquer thinner, paint solvent, etc.

The product may be fabricated in most solid colors, wood grains and patterns.

The product as manufactured is marketed in sheets, for example, sheets having widths in inches of 30, 36 or 48, and lengths in inches of 60, 72 or 96.

Figure 8:
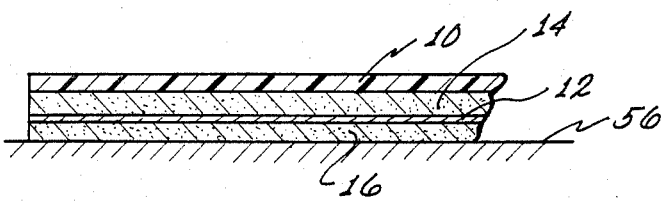

The product may also be fabricated as shown in FIGS. 5–8 wherein numeral 16 identifies a permanent bond self-adhesive back edging. A paper backing is placed over adhesive or glue 16, the paper being removable. This product is utilized by first cleaning the surface to which it is to be applied and allowed to dry. Paper backing 54 is removed from the self-adhesive conductive laminate, and it is applied to the surface. The edges may then be trimmed with a sharp blade or router and filed or sanded smooth. The conductive laminate product may be cut around obstructions, and holes may be drilled in it without harm. FIG. 8 shows the product in the form stuck adhesively to a table top 56 which is the member underneath the product.

The product can be grounded in a known manner. Bolts may be attached to the product on one side or at the back and connected to a ground with known types of connections which can be plugged in for grounding, and then the plugs can be connected to a wristlet to ground an individual operator.

The foregoing disclosure is representative of preferred forms of the invention and is to be interpreted in an illustrative rather than a limiting sense, the invention to be accorded the full scope of the claims appended hereto.

What is claimed is:

1. As an article of manufacture, a conductive laminate product for application to flat surfaces including vertical and horizontal surfaces comprising in combination a layer of relatively thin, hard plastic material, a thin layer of metallic foil, an electrically conductive adhesive material positioned to bond the foil material to the plastic sheet, and a lamination of backing material secured to the metallic foil, the laminations being bonded together by being pressed together at temperature and pressure.

2. An article as in claim 1 wherein the metallic foil is aluminum foil.

3. An article as in claim 1 wherein the plastic sheet has a thickness of approximately 0.02 inches.

4. An article as in claim 3 wherein the metallic foil has a thickness in the range of approximately 0.007–0.015 inches.

5. An article as in claim 4 wherein the backing sheet is a layer of Kraft paper.

6. An article as in claim 1 wherein the electrically conductive adhesive material is a standard electrically conductive adhesive having in it electrolytic copper in the form of a powder.

7. As an article of manufacture, a conductive laminate product adapted for application to flat surfaces including vertical and horizontal surfaces comprising, in combination, a lamination of relatively thin, hard plastic material, a thin layer of metallic foil, and an electrically conductive adhesive material positioned to bond the foil to the plastic sheet, a lamination of backing material secured to the metallic foil layer, all of the laminations being bonded together by being subjected to pressure forcing them together and with the application of heat.

8. An article as in claim 7 wherein the plastic sheet has a thickness of approximately 0.020 inches.

9. An article as in claim 7 wherein the product is in the form of a sheet of a predetermined size, the said product having a self-adhesive back, the said back being covered by a removable cover sheet whereby to expose the adhesive so that the product can be directly stuck onto a flat surface.

* * * * *